US007975887B1

(12) United States Patent
Esposito

(10) Patent No.: US 7,975,887 B1
(45) Date of Patent: Jul. 12, 2011

(54) APPARATUS FOR CARRYING A BEVERAGE BOTTLE AND ASSOCIATED METHOD

(76) Inventor: Richard P Esposito, Brooklyn, NY (US)

( * ) Notice: Subject to any disclaimer, the term of this patent is extended or adjusted under 35 U.S.C. 154(b) by 475 days.

(21) Appl. No.: 12/151,849

(22) Filed: May 9, 2008

(51) Int. Cl.
*A45F 3/16* (2006.01)
*A45F 5/00* (2006.01)

(52) U.S. Cl. ..... 224/148.6; 294/90

(58) Field of Classification Search .... 224/148.1–148.7; 294/31.2, 90; 248/311.2, 311.3, 312
See application file for complete search history.

(56) References Cited

U.S. PATENT DOCUMENTS 2,781,221 A * 2/1957 Pekora ..... 294/31.2
5,167,354 A * 12/1992 Cohanfard ..... 224/148.2
5,413,261 A * 5/1995 Wu ..... 224/148.4
5,810,218 A 9/1998 Falcaro
5,954,247 A 9/1999 Savine
6,260,811 B1 * 7/2001 O'Neil ..... 248/311.2
6,571,429 B2 * 6/2003 Yeh ..... 24/16 PB
6,626,333 B2 9/2003 Levesque

* cited by examiner

*Primary Examiner* — Justin M Larson
*Assistant Examiner* — Adam Waggenspack

(57) ABSTRACT

A bottle-carrying apparatus includes a curvilinear anchor band which has spaced opposed ends facing each other. The anchor band includes a fastener which is threadably mated to the opposed ends such that the anchor band is adjustably adapted about the top collar of the existing beverage bottle. The apparatus provides for a mechanism for rotating opposed ends of the cord along mutually exclusive first and second curvilinear travel paths. The apparatus further includes a continuous and unitary flexible cord which is juxtaposed adjacent to the existing beverage bottle and the anchor band respectively. The opposed ends of the cord are directly connected to a plurality of clasps that are. Such clasps are removably interfitted into brackets and arranged in such a manner that the clasps and the brackets rotate in sync along the first and second curvilinear paths respectively.

12 Claims, 6 Drawing Sheets

APPARATUS FOR CARRYING A BEVERAGE BOTTLE AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to beverage container carriers and, more particularly, to a rotatable beverage container carrier for providing users with a convenient and easy way to transport their water bottles and the like.

2. Prior Art

In few areas do Americans' tastes vary as widely as in their choice of a favorite beverage. Once they have reached the point where milk is not the only game in town, the available choices provide an almost unending assortment of drinks, with each category containing a plethora of selections. From frothy cappuccinos and herbal teas to citrus-tinged colas and fruity combination juices featuring apple and papaya, there is sure to be a tasty beverage for anyone. In addition to providing a refreshing liquid to accentuate a meal or a needed boost of energy in the mornings, beverages also serve a practical and healthy purpose.

In particular, human survival depends on drinking water. Water is necessary for the digestion and absorption of food, helps maintain proper muscle tone, supplies oxygen and nutrients to the cell, rids the body of wastes, and serves as a natural air conditioning system. Health officials emphasize the importance of drinking at least eight glasses of clean water each and every day to maintain good health. Perhaps it is most important for those who regularly participate in some form of exercise or sporting activity to drink plenty of water while exerting themselves in such a manner. While working out, the body expunges its moisture through perspiration, so it is especially important to avoid dehydration by having water or other liquid within reach at all times.

While keeping the body hydrated when exercising is vital, finding a way to conveniently hold on to a container of water when active can be daunting and frustrating. As many consumers can attest, carrying around a heavy, bulky water bottle or other beverage container while running or working out at the gym is, quite often, simply not practical. Having to utilize the entire hand in order to maintain a firm grip on the beverage, active persons are unable to appropriate that hand to carry other items that may be needed when the other hand is full, such as keys, a cell phone, or a purse. Wishing to be unencumbered, these consumers may opt to simply discard the beverage container, wasting expensive, unused beverage portions and denying their bodies much needed hydration.

U.S. Pat. No. 5,810,218 to Falcaro discloses a device for carrying a bottle of liquid over a shoulder consisting of a flat base with a first portion oval shaped and a second portion formed with a "U" shaped hole having a larger opening beginning at the outer edge and diminishing in size towards the middle of the base. The two ends each have a hole formed therein and a cord is strung through each of the end holes and joined with a clamp to form a continuous loop. Unfortunately, this prior art example does not prevent the cord from being tangled which causes unwanted pressure to build up in the bottle.

U.S. Pat. No. 5,954,247 to Savine discloses a bottle holder that is adapted to engage the neck of a bottle below an external annular flange of said neck, especially for suspending a bottle by means of a cord to the neck of a person. The bottle holder comprises, in combination, a cord, and a ring segment-shaped collar member made from an elastic material and comprising a ring segment comprising at each of its ends means for guiding and releasably clamping said cord such that said collar member and said cord may be set in untightened state on a container neck and then be gripped around the neck by pulling said cord and maintain grip by said clamping means. Unfortunately, this prior art example does not provide a rotating mechanism that that allows the bottle to freely rotate without tangling the cord.

U.S. Pat. No. 6,626,333 to Levesque discloses a bottle-connector wherein the bottle-connector connects a bottle to an individual, back-pack or clothing. The bottle is of the type having a neck in which an annular groove or ridge is formed. The connector has a resilient O-ring having an opening in which the neck is received. A collar is provided for adjusting the opening to an effective size such that the O-ring is snugly accommodated in the groove where the bottle has a groove or to an effective size smaller than the outer diameter of said ridge where the bottle has a ridge such that the O-ring is securely connected to the bottle. The connector also has a rigid ring connected to the O-ring and a strap or clip for connecting the rigid ring to the individual or to his back-pack or clothing. Unfortunately, this prior art example does not provide a rotating mechanism that prevents the beverage from building unwanted pressure.

Accordingly, a need remains for an auxiliary beverage container handle in order to overcome the above-noted shortcomings. The present invention satisfies such a need by providing an apparatus that is convenient and easy to use, is lightweight yet durable in design, is versatile in its applications, and provides users with a convenient means for carrying bottled water or any other desired beverage. By eliminating the need to use the whole hand to hold bulky, heavy water bottles and similar beverage containers while exercising or on the go, the present invention allows users to enjoy their favorite activities much less encumbered. In this manner, users are able to use this hand to carry other necessary items, such as keys, a wallet, or a gym bag. Since the apparatus effectively eases the transporting burden, the user will not be so quick to dispose of unfinished beverages simply in order to free their hand.

BRIEF SUMMARY OF THE INVENTION

In view of the foregoing background, it is therefore an object of the present invention to provide an apparatus for providing users with a convenient and easy way to transport their water bottles and the like. These and other objects, features, and advantages of the invention are provided by an auxiliary beverage container handle.

In a preferred embodiment of the present invention, a bottle-carrying apparatus effectively includes a curvilinear anchor band which has spaced opposed ends facing each other. Such an anchor band is adapted and removably engaged directly about a top collar of the existing beverage bottle. The anchor band is provided with a single and unitary curvilinear slot formed along the outer surface thereof. Such a curvilinear slot continuously extends along a major uninterrupted portion of a perimeter of the anchor band such that each of the brackets freely travels therealong respectively. The anchor band further includes a fastener which is threadably mated to the opposed ends such that the anchor band is adjustably adapted about the top collar of the existing beverage bottle.

The apparatus further includes a continuous and unitary flexible cord which is juxtaposed adjacent to the existing beverage bottle and the anchor band respectively. The apparatus advantageously provides for a mechanism for rotating opposed ends of the cord along mutually exclusive first and second curvilinear travel paths defined along a longitudinal length of the anchor band such that the cord is prevented from becoming twisted and tangled while the anchor band maintains a fixed and static relationship with the existing beverage bottle. Such a cord end rotating mechanism includes a plurality of brackets directly coupled to the anchor band in such a manner that each of the brackets extends radially outward from an outer surface of the anchor band while remaining spaced from the existing beverage bottle.

Such brackets include a finger protruding radially into the slot which is conveniently slidably interfitted therein such that the finger is slidably displaced along the slot. The brackets further include a vertically oriented first wall abutted against the outer surface of the anchor band and monolithically formed with the finger, a vertically oriented second wall outwardly displaced from the first wall and configured parallel thereto, a vertically oriented third wall outwardly displaced from the first and second walls and configured parallel thereto respectively and a vertically oriented fourth wall aligned above the third wall and spaced therefrom such that the third and fourth walls define an open face therebetween.

The brackets further include a horizontally oriented fifth wall monolithically formed with the first, second and third walls and registered orthogonal thereto. Such a fifth wall is effectively adjoined to the anchor band and defines a bottom surface of the clasp. The brackets further include a first cavity formed between the first and second walls respectively and a second cavity formed between the second and third walls respectively.

The apparatus further includes a plurality of clasps that are directly connected to the opposed ends of the cord respectively. Such clasps are advantageously removably interfitted into the brackets respectively and arranged in such a manner that the clasps and the brackets rotate in sync along the first and second curvilinear paths respectively. Each of the clasps includes a linear first flange extending downwardly from the cord and is removably seated within the first cavity and disposed proximal to the anchor band. Such a first flange is statically oriented along a vertical plane. A curvilinear second flange extends downwardly from the cord which is spaced adjacent to the first flange. Such a second flange is articulated along an arcuate path defined substantially orthogonal to the first and second curvilinear paths such that the second flange becomes inwardly displaced towards the first flange and removably interlocks within the second cavity by abutting a bottom edge of the fourth wall. Further, each of the clasps are independently detachable from the respective brackets such that a user can support the existing beverage bottle while only one of the clasps is interlocked with one of the corresponding brackets A method for assisting a user to transport an existing beverage bottle between remote locations includes the steps of: providing a curvilinear anchor band which has spaced opposed ends facing each other; providing and adjustably adapting the anchor band about a top collar of the existing beverage bottle by providing and threadably mating a fastener to the opposed ends of the anchor band; providing and juxtaposing a continuous and unitary flexible cord adjacent to the existing beverage bottle and the anchor band respectively; and rotating opposed ends of the cord along mutually exclusive first and second curvilinear travel paths defined along a longitudinal length of the anchor band such that the cord is prevented from becoming twisted and tangled while the anchor band maintains a fixed and static relationship with the existing beverage bottle.

The method further includes the steps of: providing and radially extending each of the brackets outwardly from an outer surface of the anchor band by providing and directly coupling a plurality of brackets to the anchor band while maintaining the brackets spaced from the existing beverage bottle; providing and directly connecting a plurality of clasps to the opposed ends of the cord respectively; removably interfitting the clasps into the brackets respectively; and synchronously rotating the clasps and the brackets along the first and second curvilinear paths respectively.

The method further includes the steps of: providing the anchor band with a single and unitary curvilinear slot formed along the outer surface thereof, the curvilinear slot continuously extending along a major uninterrupted portion of a perimeter of the anchor band; and freely traveling each of the brackets along the slot respectively.

The method further includes the steps of: providing and slidably displacing a finger along the slot by radially protruding the finger into the slot; providing and abutting a vertically oriented first wall against the outer surface of the anchor band; providing and configuring a vertically oriented second wall parallel to the first wall by outwardly displacing the second wall from the first wall; providing and configuring a vertically oriented third wall parallel to the first and second walls by outwardly displacing the third wall from the first and second walls; providing and aligning a vertically oriented fourth wall above the third wall by spacing the fourth wall from the third such that an open face is defined between the third and fourth walls; providing and registering a horizontally oriented fifth wall orthogonal to the first, second and third walls; defining a bottom surface of the clasp by adjoining the fifth wall to the anchor band; wherein the first and second walls define a first cavity therebetween; and wherein the second and third walls define a second cavity therebetween.

The method further includes the steps of: providing and downwardly extending a linear first flange from the cord; removably seating the first flange within the first cavity by disposing the first flange proximal to the anchor band; statically orienting the first flange along a vertical plane; providing and spacing a curvilinear second flange adjacent to the first flange by downwardly extending the second flange from the cord; removably interlocking the second flange within the second cavity by inwardly displacing the second flange towards the first flange; and articulating the second flange along an arcuate path defined substantially orthogonal to the first and second curvilinear paths such that the second flange is abutted with a bottom edge of the fourth wall.

The method further includes the steps of: independently detaching one of the clasps from one of the corresponding brackets; and supporting the existing beverage bottle while only one of the clasps is interlocked with one of the corresponding brackets.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
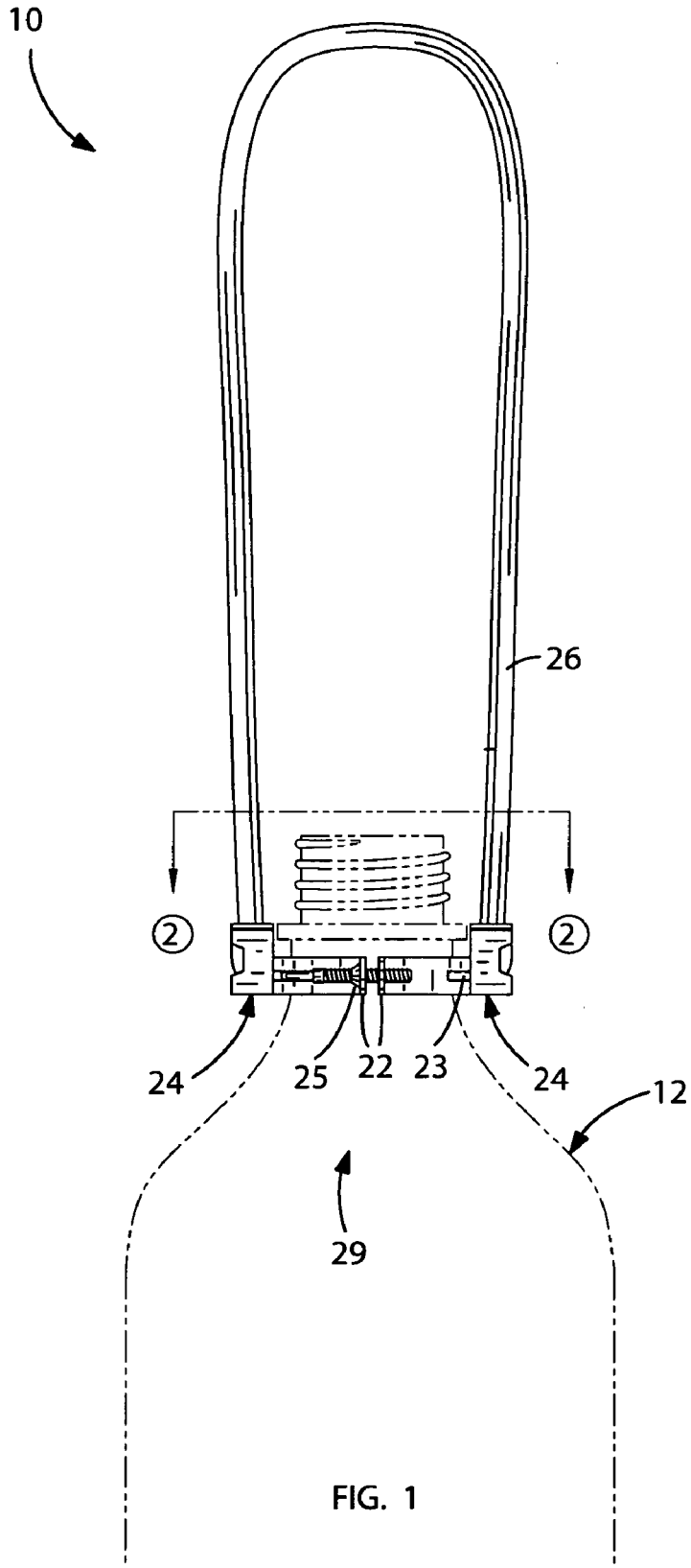
FIG. 1 is a front elevational view showing a beverage bottle carrier coupled to an existing beverage bottle, in accordance with the present invention.
Figure 2A:
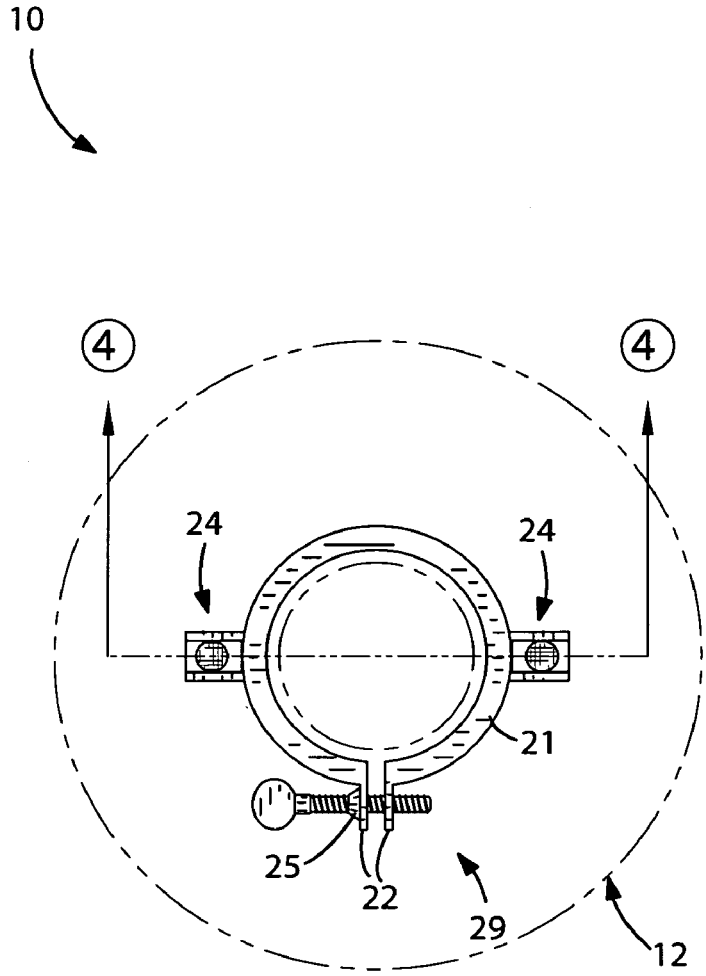
FIG. 2*a* is a top plan view of the beverage bottle carrier shown in FIG. 1.
Figure 2B:
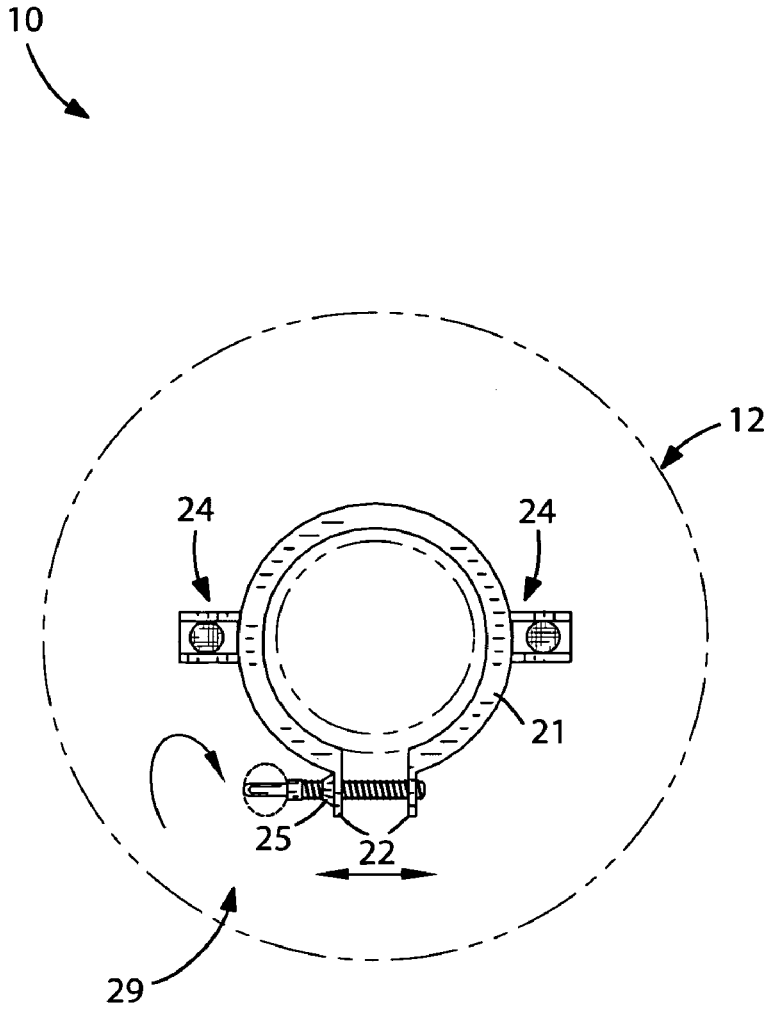
FIG. 2*b* is a top plan view of FIG. 1 showing the fastener rotatably adapted for expanding and contracting a diameter of the band positioned about the beverage bottle.
Figure 2C:
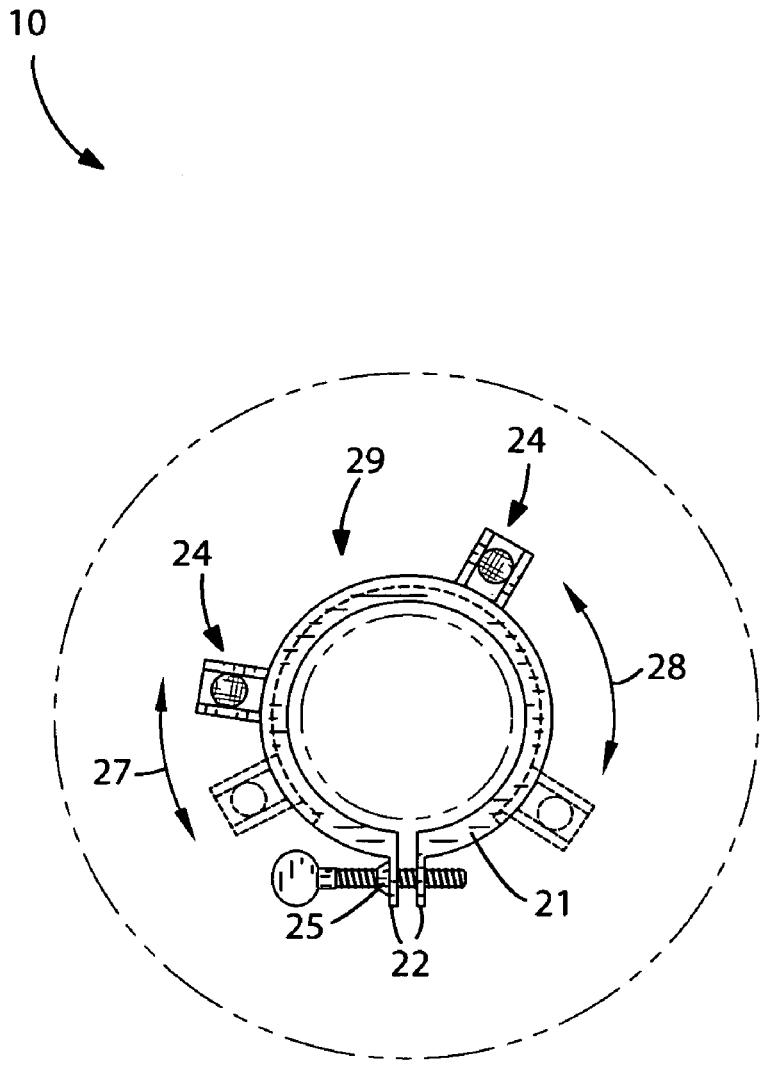
FIG. 2*c* is a top plane view of FIG. 1 showing the rotational movements of the brackets along the first and second arcuate paths respectively.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to provide an auxiliary beverage container handle. It should be understood that the apparatus 10 may be used to carry many different types of bottled beverages and should not be limited in use to only carrying bottled water, as illustrated in the figures.

Referring initially to FIGS. 1-4, a bottle-carrying apparatus 10 includes a curvilinear anchor band 21 which has spaced opposed ends 22 facing each other. Such an anchor band 21 is adapted and removably engaged directly, without the use of intervening elements, about a top collar 11 of the existing beverage bottle 12. The anchor band 21 is provided with a single and unitary curvilinear slot 23 formed along the outer surface thereof. Such a curvilinear slot 23 continuously extends along a major uninterrupted portion of a perimeter of the anchor band 21 such that each of the brackets 24 freely travels therealong respectively. The anchor band 21 further includes a fastener 25 which is threadably mated to the opposed ends 22 such that the anchor band 21 is adjustably adapted about the top collar 11 of the existing beverage bottle 12. The combination of such claimed elements is not rendered obvious to one skilled in the art because it provides the unpredictable and unexpected result of an apparatus that is adjustable to fit tightly around any type of bottle. Such a combination overcomes shortcomings associated with conventional bottle holders that lack the ability to adjust a band to fit tightly around the neck of the bottle because such conventional bottle holders will only fit over one type of beverage bottle, thereby limiting their use.

The apparatus 10 further includes a continuous and unitary flexible cord 26 which is juxtaposed adjacent to the existing beverage bottle 12 and the anchor band 21 respectively. The apparatus 10 provides for a mechanism 29 for rotating opposed ends of the cord 26 along mutually exclusive first and second curvilinear travel paths 27, 28 defined along a longitudinal length of the anchor band 21 such that the cord 26 is prevented from becoming twisted and tangled while the anchor band 21 maintains a fixed and static relationship with the existing beverage bottle 12.

Such a cord end rotating mechanism 29 includes a plurality of brackets 24 directly, without the use of intervening elements, coupled to the anchor band 21 in such a manner that each of the brackets 24 extends radially outward from an outer surface of the anchor band 21 while remaining spaced from the existing beverage bottle 12. The combination of such claimed elements is not rendered obvious to one skilled in the art because it provides an unpredictable and unexpected result that overcomes shortcomings associated with generic beverage bottle holders. The present invention prevents carbonated beverages from building unwanted pressure by providing a rotating mechanism 29 that adjusts to fit tightly around the neck of the beverage bottle. The combination of elements allows the beverage bottle to rotate in a smooth and natural manner which prevents the cord from becoming tangled. Thus, the combination eliminates unwanted fizz and spillage that would result from the pressure build up of a tangled cord when the user removes the cap from the bottle.

Figure 4:
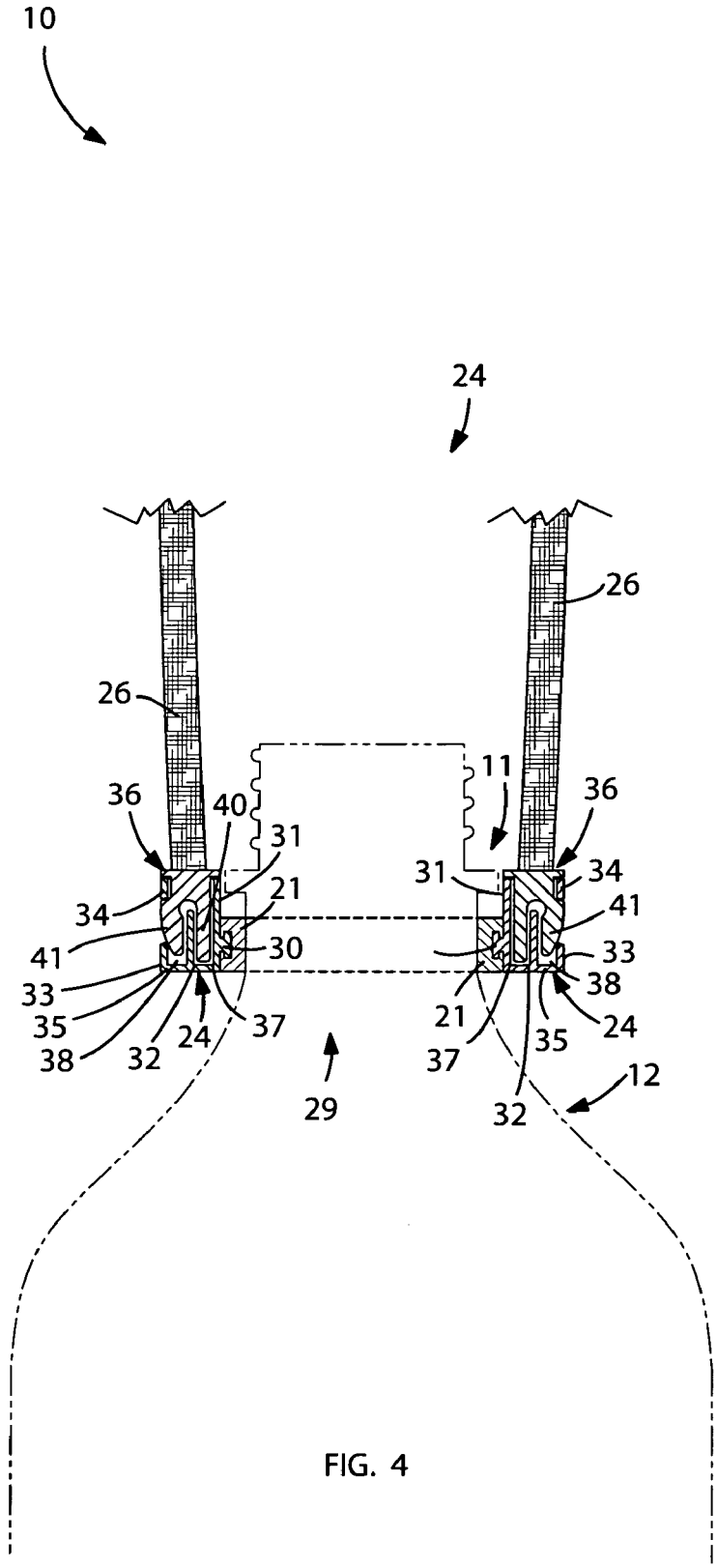
FIG. 4 is an enlarged partial cross-sectional view of the claps seated within corresponding brackets that are slidably coupled to the anchor band.

Referring to FIG. 4, the brackets 24 include a finger 30 which protrudes radially into the slot 23 which is slidably interfitted therein such that the finger 30 is slidably displaced along the slot 23. The brackets 24 further include a vertically oriented first wall 31 abutted against the outer surface of the anchor band 21 and monolithically formed with the finger 30, a vertically oriented second wall 32 outwardly displaced from the first wall 31 and configured parallel thereto, a vertically oriented third wall 33 outwardly displaced from the first and second walls 31, 32 and configured parallel thereto respectively and a vertically oriented fourth wall 34 aligned above the third wall 33 and spaced therefrom such that the third and fourth walls 33, 34 define an open face therebetween.

The brackets 24 further include a horizontally oriented fifth wall 35 monolithically formed with the first, second and third walls 31, 32, 33 and registered orthogonal thereto. Such a fifth wall 35 is adjoined to the anchor band 21 and defines a bottom surface of the clasp 36. The brackets 24 further include a first cavity 37 formed between the first and second walls 31, 32 respectively and a second cavity 38 formed between the second and third walls 32, 33 respectively.

Figure 3:
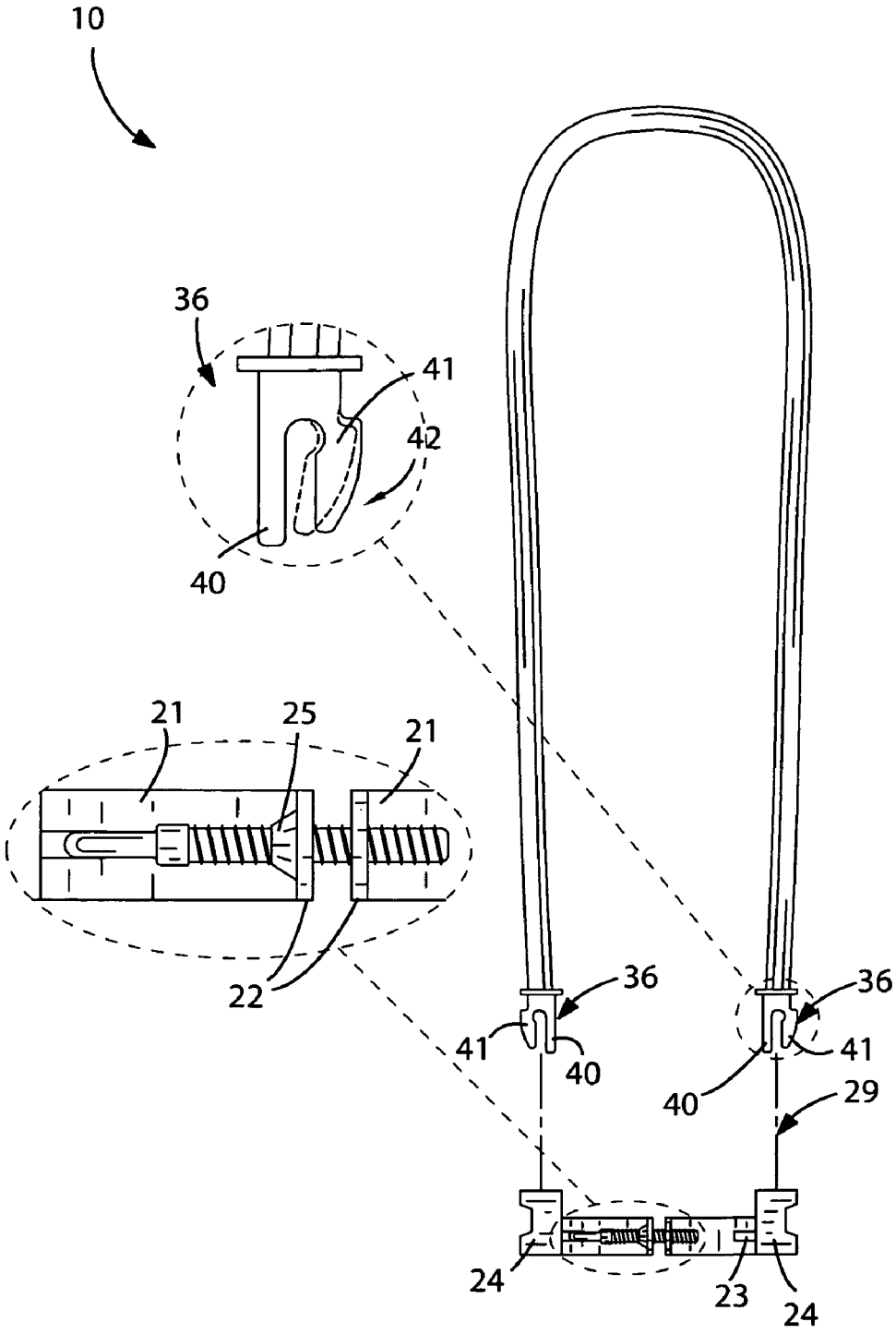
FIG. 3 is an exploded view showing enlarged partial sections of the clasps and anchor band.

Referring to FIGS. 1, 3 and 4 the apparatus further includes a plurality of clasps 36 that are directly, without the use of intervening elements, connected to the opposed ends of the cord 36 respectively. Such clasps 36 are removably interfitted into the brackets 24 respectively and arranged in such a manner that the clasps 36 and the brackets 24 rotate in sync along the first and second curvilinear paths 27, 28 respectively. Each of the clasps 36 includes a linear first flange 40 extending downwardly from the cord 26 and is removably seated within the first cavity 37 and disposed proximal to the anchor band 21. Such a first flange 40 is statically oriented along a vertical plane.

A curvilinear second flange 41 extends downwardly from the cord 26 which is spaced adjacent to the first flange 40. Such a second flange is articulated along an arcuate path 42 defined substantially orthogonal to the first and second curvilinear paths 27, 28 such that the second flange 41 becomes inwardly displaced towards the first flange 40 and removably interlocks within the second cavity 38 by abutting a bottom edge of the fourth wall 34. Further, each of the clasps are independently detachable from the respective brackets 24 such that a user can support the existing beverage bottle 12 while only one of the clasps 36 is interlocked with one of the corresponding brackets 24.

The combination of such claimed elements is not rendered obvious by one skilled in the art because it provides an unpredictable and unexpected result that overcomes shortcomings associated with generic bottle holders. The present invention's combination allows the cord 26 to be attached to the rotating mechanism 29 in such a way that minimizes the movement of the beverage bottle while walking or jogging. Advantageously, brackets 24 and clasps 36 fit together securely while being easy to attach and detach. Further, the combination allows the connected brackets 24 and clasps 36 to rotate in such a manner that the cord 26 does not get tangled and add pressure to the bottle that is being carried by the user.

In one embodiment, the present invention may include a cord 26 that is produced of durable nylon material which is suitably sized and shaped for being attached to the beverage container 12. The cord may consist of a plurality of braided members and, in a preferred embodiment, may measure twelve inches in length. The anchor band 21 may be directly attached, without the use of intervening elements, to a distal end of the cord 26. An adjusting mechanism may be included for allowing a diameter of the anchor band 21 to be adapted between expanded and contracted positions, which is important for allowing band 21 to be widened or tightened depending on the container 12 to be carried. Such an adjusting mechanism may include a thumb screw 25 that is integrated with the anchor band 21.

In use, the auxiliary beverage container handle 10 is easy and straightforward to operate. For example, first, the user expands the anchor band 21 by unscrewing the fastener 25 and pulling it outward. After slipping the anchor band 21 over the top of an enclosed beverage container 12, the user positions the anchor band 21 underneath the rounded extension of the container 12, located under the cap or lid. After tightening the fastener 21 in place about the container's neck portion, the user simply grasps the cord 26 and goes about their desired routine. When they need to take a drink in the middle of a walk or during the vigorous pedaling of a stationary bicycle, the user quickly and easily opens the container in the usual manner. Of course, the apparatus can be used in a number of different ways and should not be limited to only those types of uses mentioned herein.

In use, a method for assisting a user to transport an existing beverage bottle 12 between remote locations includes the steps of: providing a curvilinear anchor band 21 which has spaced opposed ends 22 facing each other; providing and adjustably adapting the anchor band 21 about a top collar 11 of the existing beverage bottle 12 by providing and threadably mating a fastener 25 to the opposed ends 22 of the anchor band 21; providing and juxtaposing a continuous and unitary flexible cord 26 adjacent to the existing beverage bottle 12 and the anchor band 21 respectively; and rotating opposed ends of the cord along mutually exclusive first and second curvilinear travel paths 27, 28 defined along a longitudinal length of the anchor band 21 such that the cord 26 is prevented from becoming twisted and tangled while the anchor band 21 maintains a fixed and static relationship with the existing beverage bottle 12.

In use, the method may further include the steps of: providing and radially extending each of the brackets 24 outwardly from an outer surface of the anchor band 21 by providing and directly coupling a plurality of brackets 24 to the anchor band 21 while maintaining the brackets 24 spaced from the existing beverage bottle 12; providing and directly connecting a plurality of clasps 36 to the opposed ends of the cord 26 respectively; removably interfitting the clasps 36 into the brackets 24 respectively; and synchronously rotating the clasps 36 and the brackets 24 along the first and second curvilinear paths 27, 28 respectively.

In use, the method may further include the steps of: providing the anchor band 21 with a single and unitary curvilinear slot 23 formed along the outer surface thereof, the curvilinear slot 23 continuously extending along a major uninterrupted portion of a perimeter of the anchor band 21; and freely traveling each of the brackets 24 along the slot 23 respectively.

In use, the method may further includes the steps of: providing and slidably displacing a finger 30 along the slot 23 by radially protruding the finger 30 into the slot 23; providing and abutting a vertically oriented first wall 31 against the outer surface of the anchor band 21; providing and configuring a vertically oriented second wall 32 parallel to the first wall 31 by outwardly displacing the second wall 32 from the first wall 31; providing and configuring a vertically oriented third wall 33 parallel to the first and second walls 31, 32 by outwardly displacing the third wall 33 from the first and second walls 31, 32; providing and aligning a vertically oriented fourth wall 34 above the third wall 33 by spacing the fourth wall 34 from the third 33 such that an open face is defined between the third and fourth walls 33, 34; providing and registering a horizontally oriented fifth wall 35 orthogonal to the first, second and third walls 31, 32, 33; defining a bottom surface of the clasp 36 by adjoining the fifth wall 35 to the anchor band 21; wherein the first and second 31, 32 walls define a first cavity 37 therebetween; and wherein the second and third walls 32, 33 define a second cavity 38 therebetween.

In use, the method may further including the steps of: providing and downwardly extending a linear first flange 40 from the cord 26; removably seating the first flange 40 within the first cavity 37 by disposing the first flange 40 proximal to the anchor band 21; statically orienting the first flange 40 along a vertical plane; providing and spacing a curvilinear second flange 41 adjacent to the first flange 40 by downwardly extending the second flange 41 from the cord 26; removably interlocking the second flange 41 within the second cavity 38 by inwardly displacing the second flange 41 towards the first flange 40; and articulating the second flange 41 along an arcuate path 42 defined substantially orthogonal to the first and second curvilinear paths 27, 28 such that the second flange 41 is abutted with a bottom edge of the fourth wall 34.

In use, the method may further includes the steps of: independently detaching one of the clasps 36 from one of the corresponding brackets 24; and supporting the existing beverage bottle 12 while only one of the clasps 36 is interlocked with one of the corresponding brackets 24.

The present invention, as claimed, provides the unexpected and unpredictable benefit of an apparatus 10 that is convenient and easy to use, is lightweight yet durable in design, is versatile in its applications, and provides users with a convenient means for carrying bottled water or any other desired beverage. By eliminating the need to use the whole hand to hold bulky, heavy water bottles and similar beverage containers while exercising or on the go, the present invention allows users to enjoy their favorite activities much less encumbered. In this manner, users are able to use this hand to carry other necessary items, such as keys, a wallet, or a gym bag. Since the apparatus 10 effectively eases the transporting burden, the user will not be so quick to dispose of unfinished beverages simply in order to free their hand.

While the invention has been described with respect to a certain specific embodiment, it will be appreciated that many modifications and changes may be made by those skilled in the art without departing from the spirit of the invention.

It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A bottle-carrying apparatus for assisting a user to transport an existing beverage bottle between remote locations, said bottle-carrying apparatus comprising:

an anchor band being adapted and removably engaged directly about a top collar of the existing beverage bottle;

a cord juxtaposed adjacent to the existing beverage bottle and said anchor band respectively; and means for rotating opposed ends of said cord along mutually exclusive first and second curvilinear travel paths defined along a longitudinal length of said anchor band such that said cord is prevented from becoming twisted and tangled while said anchor band maintains a fixed and static relationship with the existing beverage bottle;

wherein said means for rotating opposed ends of said cord comprises:

a plurality of brackets directly coupled to said anchor band in such a manner that each of said brackets extends radially outward from an outer surface of said anchor band while remaining spaced from the existing beverage bottle; and a plurality of clasps directly connected to said opposed ends of said cord respectively, said clasps being removably interfitted into said brackets respectively and arranged in such a manner that said clasps and said brackets rotate in sync along said first and second curvilinear paths respectively;

wherein said anchor band is provided with a single and unitary curvilinear slot formed along said outer surface thereof, said curvilinear slot continuously extending along a major uninterrupted portion of a perimeter of said anchor band such that each of said brackets freely travel therealong respectively.

2. The bottle-carrying apparatus of claim 1, wherein each of said brackets comprises:

a finger protruding radially into said slot and being slidably interfitted therein such that said finger is slidably displaced along said slot;

a vertically oriented first wall abutted against said outer surface of said anchor band and monolithically formed with said finger;

a vertically oriented second wall outwardly displaced from said first wall and being configured parallel thereto;

a vertically oriented third wall outwardly displaced from said first and second walls and being configured parallel thereto respectively;

a vertically oriented fourth wall aligned above said third wall and spaced therefrom such that said third and fourth walls define an open face therebetween;

a horizontally oriented fifth wall monolithically formed with said first, second and third walls and being registered orthogonal thereto, said fifth wall further being adjoined to said anchor band and defining a bottom surface of said clasp;

a first cavity formed between said first and second walls respectively; and a second cavity formed between said second and third walls respectively.

3. The bottle-carrying apparatus of claim 2, wherein each of said clasps comprises:

a linear first flange extending downwardly from said cord and being removably seated within said first cavity and disposed proximal to said anchor band, said first flange being statically oriented along a vertical plane; and a curvilinear second flange extending downwardly from said cord and being spaced adjacent to said first flange, said second flange being articulated along an arcuate path defined substantially orthogonal to said first and second curvilinear paths such that said second flange becomes inwardly displaced towards said first flange and removably interlocks within said second cavity by abutting a bottom edge of said fourth wall.

4. The bottle-carrying apparatus of claim 1, wherein each of said clasps are independently detachable from said respective brackets such that a user can support the existing beverage bottle while only one of said clasps is interlocked with a corresponding one of said brackets.

5. A bottle-carrying apparatus for assisting a user to transport an existing beverage bottle between remote locations, said bottle-carrying apparatus comprising:

a curvilinear anchor band having spaced opposed ends facing each other, said anchor band being adapted and removably engaged directly about a top collar of the existing beverage bottle;

a fastener threadably mated to said opposed ends such that said anchor band is adjustably adapted about the top collar of the existing beverage bottle;

a continuous and unitary flexible cord juxtaposed adjacent to the existing beverage bottle and said anchor band respectively; and means for rotating opposed ends of said cord along mutually exclusive first and second curvilinear travel paths defined along a longitudinal length of said anchor band such that said cord is prevented from becoming twisted and tangled while said anchor band maintains a fixed and static relationship with the existing beverage bottle;

wherein said means for rotating opposed ends of said cord comprises:

a plurality of brackets directly coupled to said anchor band in such a manner that each of said brackets extends radially outward from an outer surface of said anchor band while remaining spaced from the existing beverage bottle; and a plurality of clasps directly connected to said opposed ends of said cord respectively, said clasps being removably interfitted into said brackets respectively and arranged in such a manner that said clasps and said brackets rotate in sync along said first and second curvilinear paths respectively;

wherein said anchor band is provided with a single and unitary curvilinear slot formed along said outer surface thereof, said curvilinear slot continuously extending along a major uninterrupted portion of a perimeter of said anchor band such that each of said brackets freely travel therealong respectively.

6. The bottle-carrying apparatus of claim 5, wherein each of said brackets comprises:

a finger protruding radially into said slot and being slidably interfitted therein such that said finger is slidably displaced along said slot;

a vertically oriented first wall abutted against said outer surface of said anchor band and monolithically formed with said finger;

a vertically oriented second wall outwardly displaced from said first wall and being configured parallel thereto;

a vertically oriented third wall outwardly displaced from said first and second walls and being configured parallel thereto respectively;

a vertically oriented fourth wall aligned above said third wall and spaced therefrom such that said third and fourth walls define an open face therebetween;

a horizontally oriented fifth wall monolithically formed with said first, second and third walls and being registered orthogonal thereto, said fifth wall further being adjoined to said anchor band and defining a bottom surface of said clasp;

a first cavity formed between said first and second walls respectively; and a second cavity formed between said second and third walls respectively.

7. The bottle-carrying apparatus of claim 6, wherein each of said clasps comprises:

a linear first flange extending downwardly from said cord and being removably seated within said first cavity and disposed proximal to said anchor band, said first flange being statically oriented along a vertical plane; and a curvilinear second flange extending downwardly from said cord and being spaced adjacent to said first flange, said second flange being articulated along an arcuate path defined substantially orthogonal to said first and second curvilinear paths such that said second flange becomes inwardly displaced towards said first flange and removably interlocks within said second cavity by abutting a bottom edge of said fourth wall.

8. The bottle-carrying apparatus of claim 5, wherein each of said clasps are independently detachable from said respective brackets such that a user can support the existing beverage bottle while only one of said clasps is interlocked with a corresponding one of said brackets.

9. A method for assisting a user to transport an existing beverage bottle between remote locations, said method comprising the steps of:

a. providing a curvilinear anchor band having spaced opposed ends facing each other;

b. providing and adjustably adapting said anchor band about a top collar of the existing beverage bottle by providing and threadably mating a fastener to said opposed ends of said anchor band;

c. providing and juxtaposing a continuous and unitary flexible cord adjacent to the existing beverage bottle and said anchor band respectively; and d. rotating opposed ends of said cord along mutually exclusive first and second curvilinear travel paths defined along a longitudinal length of said anchor band such that said cord is prevented from becoming twisted and tangled while said anchor band maintains a fixed and static relationship with the existing beverage bottle;

wherein step d. further comprises the steps of:

providing a plurality of brackets;

radially extending each of said brackets outwardly from an outer surface of said anchor band by providing and directly coupling said brackets to said anchor band while maintaining said brackets spaced from the existing beverage bottle;

providing and directly connecting a plurality of clasps to said opposed ends of said cord respectively;

removably interfitting said clasps into said brackets respectively; and synchronously rotating said clasps and said brackets along said first and second curvilinear paths respectively;

wherein step d. further comprises the steps of:

providing said anchor band with a single and unitary curvilinear slot formed along said outer surface thereof, said curvilinear slot continuously extending along a major uninterrupted portion of a perimeter of said anchor band; and freely traveling each of said brackets along said slot respectively.

10. The method of claim 9, further comprises the steps of:

providing and slidably displacing a finger along said slot by radially protruding said finger into said slot;

providing and abutting a vertically oriented first wall against said outer surface of said anchor band;

providing and configuring a vertically oriented second wall parallel to said first wall by outwardly displacing said second wall from said first wall;

providing and configuring a vertically oriented third wall parallel to said first and second walls by outwardly displacing said third wall from said first and second walls;

providing and aligning a vertically oriented fourth wall above said third wall by spacing said fourth wall from said third such that an open face is defined between said third and fourth walls;

providing and registering a horizontally oriented fifth wall orthogonal to said first, second and third walls;

defining a bottom surface of said clasp by adjoining said fifth wall to said anchor band;

wherein said first and second walls define a first cavity therebetween; and wherein said second and third walls define a second cavity therebetween.

11. The method of claim 10, further comprising the steps of:

providing and downwardly extending a linear first flange from said cord;

removably seating said first flange within said first cavity by disposing said first flange proximal to said anchor band;

statically orienting said first flange along a vertical plane;

providing and spacing a curvilinear second flange adjacent to said first flange by downwardly extending said second flange from said cord;

removably interlocking said second flange within said second cavity by inwardly displacing said second flange towards said first flange and articulating said second flange along an arcuate path defined substantially orthogonal to said first and second curvilinear paths such that said second flange is abutted with a bottom edge of said fourth wall.

12. The method of claim 9, further comprising the steps of:

independently detaching one of said clasps from a corresponding one of said brackets; and supporting the existing beverage bottle while only one of said clasps is interlocked with a corresponding one of said brackets.

* * * * *